US005684269A

United States Patent [19]

Barnes et al.

[11] Patent Number: 5,684,269

[45] Date of Patent: Nov. 4, 1997

[54] HYDROXYLAMMONIUM NITRATE/WATER/ SELF-DEFLAGRATING FUELS AS GAS GENERATING PYROTECHNICS FOR USE IN AUTOMOTIVE PASSIVE RESTRAINT SYSTEMS

[75] Inventors: Michael W. Barnes, Brigham City; Bradley D. Harris, Farmington; Darrin L. Johnson, Uintah Highlands, all of Utah

[73] Assignee: Morton International, Inc., Chicago, Ill.

[21] Appl. No.: 616,543

[22] Filed: Mar. 15, 1996

[51] Int. Cl.[6] ..... C06B 31/28

[52] U.S. Cl. ..... 149/45; 149/46; 149/92

[58] Field of Search ..... 149/45, 46, 92

[56] References Cited

U.S. PATENT DOCUMENTS

| | | | |
|---|---|---|---|
| 4,184,901 | 1/1980 | Tanner, Jr. et al. | 149/19.6 |
| 4,369,079 | 1/1983 | Shaw | 149/2 |
| 4,370,181 | 1/1983 | Lundstrom et al. | 149/2 |
| 4,718,953 | 1/1988 | Nguyen et al. | 149/17 |
| 4,878,968 | 11/1989 | Willer et al. | 149/45 |
| 4,946,521 | 8/1990 | Walker et al. | 149/46 X |
| 5,060,973 | 10/1991 | Giovannetti | 280/736 |
| 5,197,758 | 3/1993 | Lund et al. | 280/741 |
| 5,223,057 | 6/1993 | Mueller et al. | 149/45 |
| 5,232,526 | 8/1993 | Willer et al. | 149/45 |
| 5,431,103 | 7/1995 | Hock et al. | 102/287 |
| 5,574,240 | 11/1996 | Cartwright | 149/46 X |

FOREIGN PATENT DOCUMENTS 9509825 4/1995 WIPO .

*Primary Examiner*—Peter A. Nelson

*Attorney, Agent, or Firm*—Wayne E. Nacker; Gerald K. White

[57] ABSTRACT

Liquid gas generant compositions are aqueous solutions of hydroxylammonium nitrate as the oxidizer and a fuel selected from the group consisting of nitrate salts of amines of the formulae:

$A^1$) an amino tetrazole or amino triazole, $A^2$) an amine of the formulae (I) $(NHZ)_2$—C=O, (II) $(NHZ)_2$—C=NZ, (III) HN—$(CO—NHZ)_2$, where the Zs are the same or different and are selected from H and $NH_2$, $A^3$) $C_2$–$C_3$-alkyldiamine, and mixtures of the nitrate salts of amines of the above formulae.

6 Claims, No Drawings

HYDROXYLAMMONIUM NITRATE/WATER/ SELF-DEFLAGRATING FUELS AS GAS GENERATING PYROTECHNICS FOR USE IN AUTOMOTIVE PASSIVE RESTRAINT SYSTEMS

The present invention is directed to gas generant compositions, such as those used to inflate automotive airbags, and particularly to liquid gas generant compositions which are an aqueous solution of hydroxyl ammonium nitrate and a self-deflagrating fuel.

BACKGROUND OF THE INVENTION

U.S. Pat. No. 5,060,973, the teachings of which are incorporated herein by reference, describes an inflator utilizing a liquid fuel which is ignited by a small explosive charge. The liquid fuel mentioned in this patent is an aqueous solution of hydroxyl ammonium nitrate (HAN) as an oxidizer and triethanol ammonium nitrate (TEAN) as a fuel.

HAN/TEAN/water pyrotechnics and propellants have been thoroughly investigated as propellants for use in guns, e.g. N. Klein "Liquid Propellants for Use in Guns" in *Gun Propulsion Technology,* Vol. 109, Progress in Astronautics and Aeronautics, AIAA Pub., 1988, p. 473 ff. The HAN/TEAN/water combination has since been investigated as a gas generant in automotive passive restraint systems, e.g., as suggested by above-referenced U.S. Pat. No. 5,060,973. While HAN/TEAN/water has proven acceptable for the operating conditions in guns, operating conditions in automobile inflators are quite different. In particular, operating pressures must be considerably lower to avoid a heavy inflator. Further, the residence time of combustion products is considerably shorter in an inflator, leading to incomplete combustion of HAN/TEAN/water compositions. Both of these conditions result in higher than acceptable levels of undesirable combustion products, particularly oxides of nitrogen and carbon monoxide.

An additional problem with the HAN/TEAN/water combination is that in order to effectuate stoichiometric combustion of TEAN, a relatively high level of HAN is required. This presents two problems: 1) HAN has marginal thermal stability and 2) HAN is incompatible with a wide variety of materials which presents long-term storage problems.

SUMMARY OF THE INVENTION

In accordance with the present invention there is provided a liquid gas generant composition comprising A) between about 50 and about 80 wt. % of a fuel, and B) between about 20 and about 50 wt % of hydroxylammonium nitrate as oxidizer based on total weight of A) plus B); plus C) sufficient water to fully dissolve A) and B) therein. The fuel A) is a nitrate salt of an amine selected from:

$A^1$) an amino tetrazole or amino triazole, $A^2$) an compound of the formulae (I) $(NHZ)_2$—C=O, (II) $(NHZ)_2$—C=NZ, (III) HN—$(CO—NHZ)_2$, where the Zs are the same or different and are selected from H and $NH_2$, $A^3$) $C_2$–$C_3$-alkyldiamine, and mixtures of the nitrate salts of amines of the above formulae.

DETAILED DESCRIPTION OF CERTAIN PREFERRED EMBODIMENTS

The term "fuel" is used herein to designate a chemical lacking sufficient internal oxygen to burn completely to $CO_2$, $H_2O$ and $N_2$. The term "oxidizer" is used herein to designate a chemical having excess oxygen for burning completely to $CO_2$, $H_2O$ and $N_2$. The fuels used herein, though lacking sufficient oxygen to burn completely to $CO_2$, $H_2O$ and $N_2$, nevertheless, have a substantial amount of internal oxygen. In fact, they have sufficient oxygen that they are "self-deflagrating"; that is, they have sufficient internal oxygen to sustain combustion in the absence of an external oxidizer. If the fuels used in accordance with the invention were placed in a vacuum and ignited, they would burn to completion, though producing significant amounts of incompletely oxidized products, such as CO. Accordingly, the self-deflagrating fuels are used in conjunction with an oxidizer, i.e., HAN.

Because the fuels are self-deflagrating, the problem of incomplete combustion with HAN/TEAN/water compositions is eliminated. Also, because of the high levels of internal oxidizer, the thermal stability problems of HAN and any incompatibility problems associated with HAN are substantially reduced or eliminated.

Examples of amines of formula $A^1$), the nitrate salts of which are fuels in accordance with the invention, include, but are not limited to 5-aminotetrazole, 3-amino-1,2,4-triazole, and 3,5-diamino-1,2,4-triazole. Amines of the formulae of $A^2$) include, but are not limited to urea, guanidine, aminoguanidine, diaminoguanidine, biuret and semicarbazide. Ethylenediamine is the preferred diamine of formula $A^3$). In most cases, the amines of the above-formulae form only the mono-nitrate salt; however, when di- or tri-nitrates are available, e.g., ethylene diamine dinitrate, these may be used and may even be preferred.

The fuels A), including those of formulae $A^1$), $A^2$), and $A^3$) each have the advantage relative to TEAN in that they are highly internally self-oxidized. Accordingly, on a weight basis, the oxygen to fuel ratio required to achieve a stoichiometric mixture of oxidizer and fuel are lower, and in accordance with compositions of the present invention, the oxidizer, HAN, comprises no more than 50 wt % of the total of oxidizer plus fuel. Accordingly, the HAN is diluted and less susceptible to thermal instability.

The oxidizer to fuel stoichiometry in compositions in accordance with the present invention is preferably at or near 1, e.g., from about 0.9 to about 1.1. Herein, an oxidizer to fuel ratio of 1.0 is defined as being precisely enough oxidizer (HAN) to oxidizer the fuel to carbon dioxide, nitrogen, and water. Thus in a formulation where the oxidizer to fuel ratio is 1.1, there is a 10 molar percent excess of oxidizer, and so forth.

Water, component C), is used to the extent necessary to dissolve the fuel A) and oxidizer B) or to form an acceptable slurry. Water is used at a high enough level such that theoretical combustion temperature as predicted by standard thermodynamic prediction computer codes such as the NWC PEP code is between 1500° K. and 1900° K.

Accordingly, water is typically employed at between about 20 up to about 50 wt % relative to the total weight of the fuel A) plus the oxidizer B). Water, of course, does not contribute to the exothermic reaction, and if used at too high levels will tend to quench the reaction. Nevertheless, when the fuel is ignited, the water vaporizes, contributing to the total amount of gas generated.

Being solutions or slurries, the compositions of the present invention are easily prepared. HAN is sold commercially as a solution, e.g., an 80 wt % solution by Olin Corp. Typically, such a solution is diluted with such additional water as desired in the composition. Then the water-soluble fuel A) is added with stirring, until dissolved or a stable slurry is formed.

The compositions are useful in liquid fuel gas generants, such as is described in above-identified U.S. Pat. No. 5,060,973.

The invention will now be described in greater detail by way of specific examples.

Example 1 (comparative), and 2–4

Formulations were prepared using HAN in stoichiometry with fuels including Example (comparative) 1, TEAN; Example 2, 5-amino tetrazole nitrate (ATN); Example 3, guanidine nitrate ($GuNO_3$); and Example 4, ethylene diamine dinitrate (EDDN). Properties of the compositions are provided in the table below.

| Fuel | TEAN (Ex. 1) | ATN (Ex. 2) | $GuNO_3$ (Ex. 3) | EDDN (Ex. 4) |
|---|---|---|---|---|
| Oxid./Fuel | 53.21/16.79 | 17.14/52.86 | 35.23/44.77 | 30.55/39.45 |
| /$H_2O$ | /30 | /30 | /20 | /30 |
| % HAN* | 76.0 | 24.9 | 44.0 | 43.6 |
| Tc °K** | 1749 | 1958 | 1756 | 1692 |
| M/100 gm*** | 4.51 | 4.35 | 4.41 | 4.53 |

*wt % HAN calculated as HAN/(HAN + fuel)
**Combustion temperature
***Moles of gas generated per 100 grams of fuel It can be seen that in Examples 2–3, substantially less HAN is used to provide the stoichiometric equivalent of the fuel, whereby a substantially more stable composition is provided.

What is claimed is:

1. A liquid gas generant composition for inflating automotive airbags comprising A) between about 50 and about 80 wt. % of a fuel, and between about 20 and B) about 50 wt % of hydroxylammonium nitrate as oxidizer based on total weight of A) plus B); plus C) sufficient water to dissolve or slurry A) and B) therein, said fuel A) being a nitrate salt of an amine selected from the group consisting of:

$A^1$) an amino tetrazole or amino triazole, $A^2$) a compound of the formulae (I) $(NHZ)_2$—C=O, (II) $(NHZ)_2$—C=NZ, (III) HN—$(CO—NHZ)_2$, where the Zs are the same or different and are selected from H and $NH_2$, $A^3$) $C_2$–$C_3$-alkyldiamine, and mixtures of the nitrate salts of amines of the above formulae.

2. A composition according to claim 1 wherein water is added in amounts such that the theoretical combustion temperature of said composition is between 1500° and 1900° K.

3. A composition according to claim 1 wherein said water comprises between about 20 and about 50 wt % relative to the total of A) plus B) plus C).

4. A liquid gas generant composition for inflating automotive airbags comprising A) between about 50 and about 80 wt. % of a fuel, and B) between about 20 and about 50 wt % of hydroxylammonium nitrate as oxidizer based on total weight of A) plus B) plus C) sufficient water to dissolve or slurry A) and B) therein, said fuel A) being a nitrate salt of an amine selected from the group consisting of:

$A^1$) an amino tetrazole or amino triazole, $A^2$) a compound of the formulae (I) $(NHZ)_2$—C=O, (II) $(NHZ)_2$—C=NZ, (III) HN—$(CO—NRZ)_2$, where the Zs are the same or different and are selected from H and $NH_2$, $A^3$) $C_2$–$C_3$-alkyldiamine, and mixtures of the nitrate salts of amines of the above formulae, said fuel and said hydroxylammonium nitrate being used at a stoichiometric ratio of between about 0.9 and about 1.1.

5. A composition according to claim 4 wherein water is added in amounts such that the theoretical combustion temperature of said composition is between 1500° and 1900° K.

6. A composition according to claim 4 wherein said water comprises between about 20 and about 50 wt % relative to the total of A) plus B) plus C).

* * * * *